US009132463B2

(12) United States Patent
Ota et al.

(10) Patent No.: US 9,132,463 B2
(45) Date of Patent: Sep. 15, 2015

(54) DIE CUSHION DEVICE FOR PRESS MACHINE

(75) Inventors: Hidenari Ota, Tokyo (JP); Yuichi Otsuki, Tokyo (JP)

(73) Assignee: IHI Corporation, Tokyo (JP)

( * ) Notice: Subject to any disclaimer, the term of this patent is extended or adjusted under 35 U.S.C. 154(b) by 1197 days.

(21) Appl. No.: 12/903,930

(22) Filed: Oct. 13, 2010

(65) Prior Publication Data

US 2011/0083487 A1 Apr. 14, 2011

(30) Foreign Application Priority Data

Oct. 13, 2009 (JP) ..... 2009/236508

(51) Int. Cl.

*B21J 9/18* (2006.01)
*B21D 24/14* (2006.01)
*B21D 24/02* (2006.01)

(52) U.S. Cl.

CPC ..... *B21D 24/14* (2013.01); *B21D 24/02* (2013.01)

(58) Field of Classification Search

CPC ..... B21D 24/08; B21D 1/14; B21D 24/02; B21D 7/06; B21D 24/14; B21J 9/12; B21J 9/18; B21J 7/34; B21J 13/04; B21J 15/22; H01R 43/0427; B30B 1/34; B30B 1/32; B30B 15/007; B30B 1/003; B30B 15/16; B30B 9/321; B30B 9/06; B30B 15/0052; B25B 27/10; B27D 3/00; B61C 13/18; B65B 13/20

USPC ..... 72/443, 351, 453.13, 453.01–453.18, 72/454; 100/269.01–269.21, 159

See application file for complete search history.

(56) References Cited

U.S. PATENT DOCUMENTS

| | | | | |
|---|---|---|---|---|
| 5,560,237 | A * | 10/1996 | Yasuda et al. | 72/13.4 |
| 5,687,598 | A * | 11/1997 | Kirii et al. | 72/21.5 |
| 2002/0134256 | A1 * | 9/2002 | Futamura et al. | 100/269.01 |
| 2004/0094048 | A1 * | 5/2004 | Yamanaka et al. | 100/269.01 |
| 2006/0107723 | A1 * | 5/2006 | Matsubara et al. | 72/351 |
| 2008/0141751 | A1 * | 6/2008 | Baba et al. | 72/351 |
| 2009/0090161 | A1 * | 4/2009 | Amino | 72/453.12 |

FOREIGN PATENT DOCUMENTS

| | | | |
|---|---|---|---|
| JP | 2006-000908 | A | 1/2006 |
| JP | 2006-055872 | | 3/2006 |
| JP | 2008-280907 | A | 11/2008 |

* cited by examiner

*Primary Examiner* — Shelley Self
*Assistant Examiner* — Lawrence Averick
(74) *Attorney, Agent, or Firm* — Griffin & Szipl, P.C.

(57) ABSTRACT

A die cushion device includes: a cushion pad which is located below a blank holder and is movable up and down while being synchronized with the blank holder; a linear driving device which drives a brake member along a predetermined line and regenerates energy from the linear movement of the brake member by combination of a servo motor and a conversion mechanism; and a hydraulic speed change device which transfers the speed of the cushion pad to the brake member via the pressure of hydraulic fluid while increasing the speed and transfers the speed of the brake member to the cushion pad via the pressure of the enclosed hydraulic fluid while decreasing the speed.

10 Claims, 5 Drawing Sheets

DIE CUSHION DEVICE FOR PRESS MACHINE

This application claims priority from Japanese Patent Application No. 2009/236508, filed Oct. 13, 2009, the entire disclosure of which is incorporated herein by reference.

BACKGROUND OF THE INVENTION

1. Field of the Invention

The present invention relates to a die cushion device for a press machine capable of regenerating energy to achieve high energy efficiency.

2. Description of the Related Art

A die cushion device is defined as a device that clamps a workpiece between the blank holder and the upper die of a press machine and applies a blank holding force (a cushion force) to the workpiece.

For some time, there have been proposed various types of die cushion devices as the die cushion device for a press machine (for example, refer to Patent Documents 1 to 3).

Patent Document 1 discloses a hydraulic force increasing linear motor type, and Patent Documents 2 and 3 disclose a ball screw type.

As shown in FIG. 1, the die cushion device of Patent Document 1 includes a body container 51; a movable body 52 which is movable along the inner wall of the body container 51; a cylinder 53 which is connected to communicate with the inside of the body container 51; a stator 57 which is installed at the cylinder 53; a piston head 54 which slides along the inner wall of the cylinder 53; a piston rod 55 which is attached to the piston head 54; and a mover 58 which is connected to the piston rod 55, wherein a hydraulic fluid L is commonly accommodated in the body container 51 and the cylinder 53 and is also sealed by the movable body 52 and the piston head 54, wherein the cross-sectional area of the cylinder 53 is smaller than that of the movable body, wherein the stator 57 and the mover 58 constitute a linear motor, wherein the linear motor is driven to make the piston head 54 slide on the inside of the cylinder 53 via the piston rod 55 so that the hydraulic fluid L accommodated in the cylinder 53 flows into or from the body container 51 to move the movable body 52.

The die cushion device disclosed in Patent Document 2 is adapted to drive a ball screw using a force applied from a servo motor via a deceleration mechanism such as a timing belt.

[Patent Document 1]

Japanese Patent Application Laid-Open No. 2008-280907, "LINEAR MOTOR TYPE PRESSURIZATION PUMP AND DIE CUSHION DEVICE HAVING THE SAME"

[Patent Document 2]

Japanese Patent Application Laid-Open No. 2006-000908, "DIE CUSHION DEVICE"

[Patent Document 3]

Japanese Patent Application Laid-Open No. 2006-055872, "DIE CUSHION DEVICE"

SUMMARY OF THE INVENTION

In the hydraulic force increasing linear motor type die cushion device (Patent Document 1), the efficiency of the linear motor is lower than that of a rotary motor, which decreases the energy regeneration efficiency limit. In other words, since loss in the linear motor is large, the coil is forcibly cooled by cooling water or the like in many cases. As a result, there are problems in that the energy efficiency of the entire die cushion device decreases, and the connection structure of the pipe is complex.

Further, in the ball screw type die cushion device (Patent Document 2), since impact force directly acts on the ball screw, there is a problem in that the strength and the durability of the driving mechanism are not easily ensured.

For this reason, for example, an impact alleviation mechanism disclosed in Patent Document 3 is separately required.

Further, when an air cushion is simultaneously used, the existing hydraulic force increasing linear motor type die cushion device has problems in that the upward movement speed of a cushion pad cannot be controlled and the cushion pad cannot be maintained at an arbitrary position.

The invention is contrived to solve the above-described problems.

That is, a first object of the invention is to provide a die cushion device for a press machine capable of preventing impact force from being directly applied to an energy regenerating mechanism, ensuring high durability and impact resistance, enhancing energy efficiency, and regenerating energy.

Further, a second object of the invention is to provide a die cushion device for a press machine capable of controlling an upward movement speed of a cushion pad and maintaining the cushion pad at an arbitrary position even when an air cushion is simultaneously used.

According to the invention, there is provided a die cushion device for a press machine that clamps a workpiece between a blank holder and an upper die of the press machine and moves the blank holder up and down while applying an upward cushion force to the blank holder via a cushion pad, the die cushion device comprising:

a linear driving device which drives a brake member along a predetermined line and regenerates energy from the linear movement of the brake member by combination of a servo motor and a conversion mechanism that converts the rotational movement of the servo motor into the linear movement of the brake member; and a hydraulic speed change device which transfers the speed of the cushion pad to the brake member via the pressure of hydraulic fluid while increasing the speed and transfers the speed of the brake member to the cushion pad via the pressure of the hydraulic fluid while decreasing the speed.

According to the preferred embodiment of the invention, the hydraulic speed change device includes:

a large diameter piston which is located below the cushion pad and is movable up and down along with the blank holder;

a small diameter piston which is connected to the brake member to move linearly along with the brake member and has a diameter smaller than that of the large diameter piston; and a Pascal cylinder which guides the large diameter piston and the small diameter piston to be independently movable in an axial direction thereof and encloses a noncompressible first hydraulic fluid therebetween.

The Pascal cylinder includes an upper chamber liquid-tightly sealing a rod side of the large diameter piston, a lower chamber liquid-tightly sealing a rod side of the small diameter piston, and a middle chamber liquid-tightly sealing a space between the large diameter piston and the small diameter piston, and wherein the upper chamber and the lower chamber enclose a noncompressible second hydraulic fluid therein, and communicate with each other via a communication pipe.

The die cushion device further includes: an upper chamber closing valve which is installed in the communication pipe and is switchable between a communication position that the upper chamber communicates with the lower chamber and a non-return position that the reverse flow of the second hydraulic fluid from the upper chamber to the lower chamber is stopped; and a closing valve controller which switches the upper chamber closing valve to the communication position or the non-return position.

According to an embodiment of the invention, the conversion mechanism includes a ball screw rotated by the servo motor and a nut threadably connected to the ball screw, and wherein the brake member is fixed to the nut and moves linearly along with the nut in accordance with the rotation of the ball screw.

According to another embodiment of the invention, the conversion mechanism includes a pinion rotated by the servo motor and a rack meshing with the pinion and fixed to the brake member. The brake member moves linearly in accordance with the rotation of the pinion.

According to the configuration of the invention, since the hydraulic speed change device is provided, the vertical movement of the cushion pad receiving the impact force is transferred to the brake member of the linear driving device via the pressure of the hydraulic fluid in accordance with Pascal's principle while increasing the speed thereof. For this reason, since the impact force acting on the energy regenerating mechanism (the linear driving device) is alleviated, it is possible to improve the durability and impact resistance, and to regenerate energy from the accelerated brake member with high efficiency.

Further, since the hydraulic speed change device converts the linear movement of the brake member of the linear driving device into the vertical movement of the cushion pad via the pressure of the hydraulic fluid while decreasing the speed thereof, it is possible to reuse the regenerated energy and thus to improve overall energy efficiency.

In particular, when the linear driving device capable of regenerating energy is configured by the combination of the servo motor and the conversion mechanism converting the rotational movement of the servo motor into the linear movement of the brake member, it is possible to realize a die cushion device with high efficiency.

Furthermore, according to the configuration of the embodiment of the invention, since the upper and lower chambers each enclosing the noncompressible second hydraulic fluid therein and communicating with each other via the communication pipe, the upper chamber closing valve, and the closing valve controller are provided, even when the air cushion is simultaneously used, it is possible to control the upward movement speed of the cushion pad, and to maintain the cushion pad at an arbitrary position.

DESCRIPTION OF THE PREFERRED EMBODIMENTS

Figure 1:
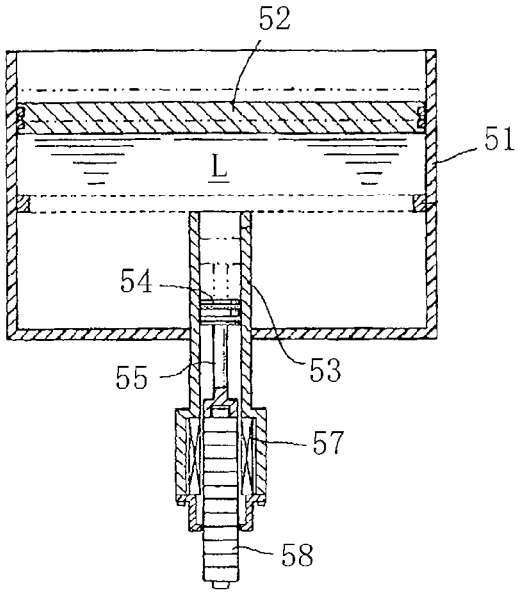
FIG. 1 PRIOR ART
FIG. 1 is a configuration diagram illustrating a die cushion device of Patent Document 1.

Hereinafter, the preferred embodiments of the invention will be described with reference to the accompanying drawings. In addition, in the respective drawings, the same reference numerals will be given to the same components, and the repetitive description thereof will be omitted.

Figure 2:
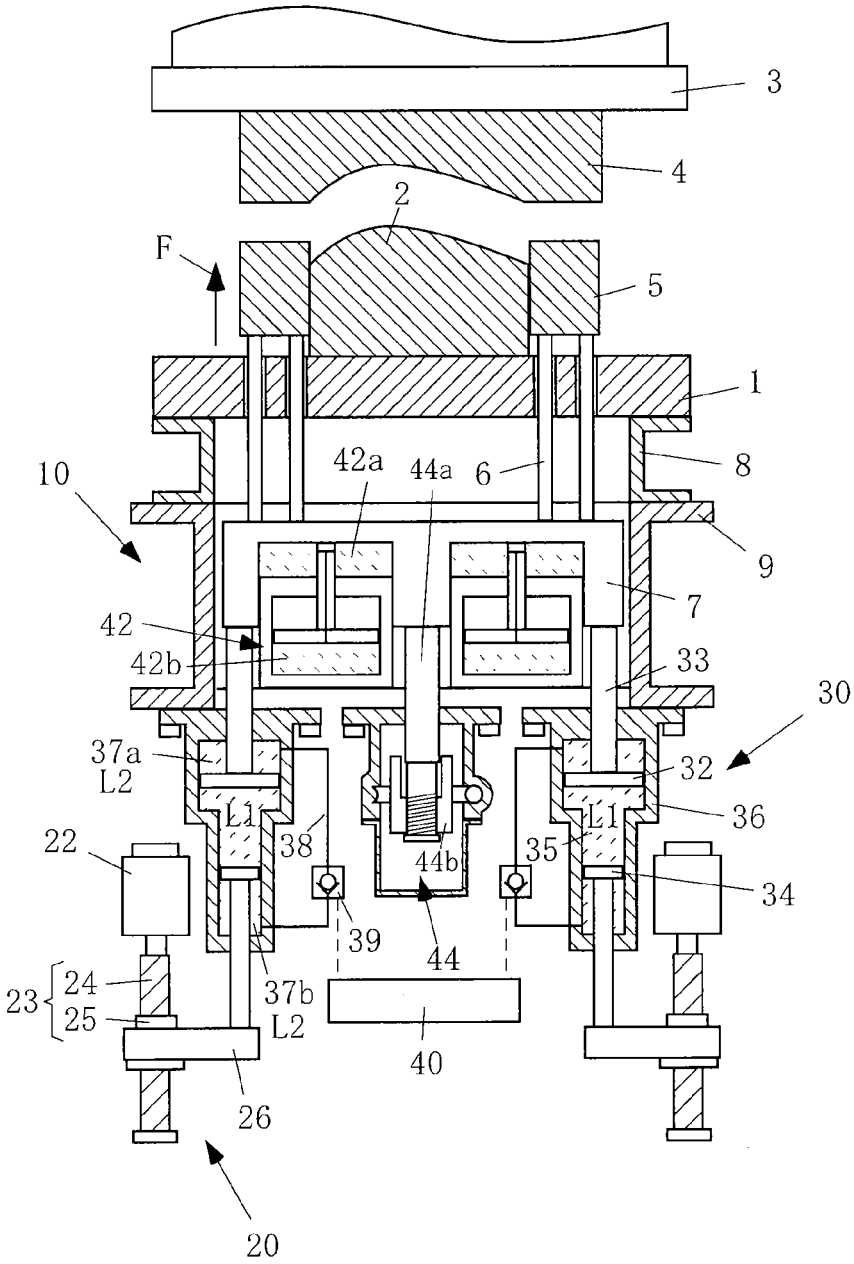
FIG. 2 is an overall configuration diagram illustrating a press machine equipped with a die cushion device according to a first embodiment of the invention.

FIG. 2 is an overall configuration diagram illustrating a press machine equipped with a die cushion device according to a first embodiment of the invention.

In the drawing, the press machine is adapted to move down an upper die 4 toward a lower die 2, and press a workpiece (also called a blank) not shown between the lower die 2 and the upper die 4 so that the workpiece has a predetermined shape, where the upper die 4 is fixed onto a lower surface of a slide 3 adapted to be movable up and down, and the lower die 2 is fixed onto an upper surface of a bolster 1.

In this case, the lower die 2 is supported by the bolster 1, and the bolster 1 is supported by a bed 9 via a moving bolster 8, whereby the bed 9 receives the press forming load.

In addition, when the workpiece is press-formed by the upper die 4 and the lower die 2, a blank holder 5 holding the workpiece is supported by a cushion pad 7 via a cushion pin 6.

The blank holder 5 is used to hold the workpiece between the blank holder and the upper die 4 when press-forming the workpiece, and performs blank holding by supporting the peripheral edge portion of the lower surface of the workpiece.

The cushion pin 6 is a rod-shaped component that is movable up and down and extends vertically while penetrating the bolster 1.

The cushion pad 7 supports the cushion pin 6 on its upper surface. The cushion pad 7 is located below the blank holder 5, and is adapted to move up and down while being synchronized with the blank holder 5.

With the above-described configuration, the blank holder 5, the cushion pin 6, and the cushion pad 7 are adapted to move up and down in a synchronized manner.

A die cushion device 10 of the invention is a device that clamps the workpiece (the pressed material) between the blank holder 5 and the upper die 4 of the press machine, and moves the blank holder up and down while applying an upward cushion force F to the blank holder 5 via the cushion pin 6 and the cushion pad 7.

In FIG. 2, the die cushion device 10 of the invention includes a linear driving device 20 and a hydraulic speed change device 30. The linear driving device 20 and the hydraulic speed change device 30 shown on the left and right of the drawing make two pairs, but may make a pair or three pairs or more as long as the cushion pad 7 is held in the horizontal direction.

The linear driving device 20 is adapted to drive a brake member 26 along a predetermined line and to regenerate energy from the linear movement of the brake member 26 by combination of a servo motor 22 and a conversion mechanism 23 that converts the rotational movement of the servo motor 22 into the linear movement of the brake member 26.

The conversion mechanism 23 of this example includes a ball screw 24 that is rotated by the servo motor 22 and a nut 25 that is threadably connected to the ball screw 24. That is, the linear driving device 20 of the first embodiment includes the servo motor 22, the ball screw 24, and the brake member 26.

The brake member 26 is fixed to the nut 25, and moves linearly along with the nut 25 in accordance with the rotation of the ball screw 24.

With this configuration, when the brake member 26 moves up and down, the ball screw 24 threadably connected thereto rotates to rotationally drive the servo motor 22 and to regenerate energy. The regenerated energy is accumulated as electrical power or is supplied to the external device.

On the contrary, when the servo motor 22 rotationally drive the ball screw 24, the brake member 26 threadably connected thereto is moved up and down.

The hydraulic speed change device 30 is adapted to communicate the vertical movement of the cushion pad 7 to the brake member 26 via the pressure of the enclosed hydraulic fluid such that the speed of the vertical movement of the cushion pad 7 is converted to the increased speed of the linear movement of the brake member 26. The hydraulic speed change device 30 is adapted to communicate the linear movement of the brake member 26 to the cushion pad 7 via the pressure of the enclosed hydraulic fluid such that the speed of the linear movement of the brake member 26 is converted to the decreased speed of the vertical movement of the cushion pad 7.

The hydraulic speed change device 30 includes a large diameter piston 32, a small diameter piston 34, and a Pascal cylinder 36.

The large diameter piston 32 is located below the cushion pad 7, and is adapted to move up and down together with the blank holder 5. That is, in this example, a piston rod 33 is connected to the upper surface of the large diameter piston 32, extends upward in the axial direction, and then its upper end constantly applies the upward cushion force F to the blank holder 5 via the cushion pad 7 and the cushion pin 6, whereby these components are constantly adapted to move up and down together.

The large diameter piston 32 has a cylindrical outer peripheral surface, and has a liquid-tight seal (for example, a packing or a piston seal) not shown and provided on the outer peripheral surface, whereby the large diameter piston is freely movable in the axial direction (that is, the vertical direction) while liquid-tightly holding fluid inside the cylinder of the Pascal cylinder 36.

The small diameter piston 34 is connected to the brake member 26 of the linear driving device 20 so as to be movable linearly together with the brake member.

The small diameter piston 34 has a diameter smaller than that of the large diameter piston 32 (for example, the diameter of the piston 34 is half of that of the piston 32), has a cylindrical outer peripheral surface similarly to the large diameter piston 32, and has a liquid-tight seal (for example, a packing or a piston seal) not shown and provided on the outer peripheral surface, whereby the small diameter piston is freely movable in the axial direction (that is, the vertical direction) while liquid-tightly holding fluid inside the cylinder of the Pascal cylinder 36.

In this example, the small diameter piston 34 and its cylinder has the vertical axis that is aligned with the axis of the large diameter piston 32 and its cylinder while the small diameter piston 34 is located below the large diameter piston 32.

The Pascal cylinder 36 guides the large diameter piston 32 and the small diameter piston 34 so as to be independently movable in the axial direction, and encloses a noncompressible first hydraulic fluid L1 therebetween.

The first hydraulic fluid L1 may be, for example, hydraulic oil for a hydraulic device.

A space located between the large diameter piston 32 and the small diameter piston 34 and enclosing the noncompressible first hydraulic fluid L1 will be hereinafter referred to as a "middle chamber 35".

The middle chamber 35 is a communication channel that has a cross-sectional area equal to or larger than that of the small diameter piston 34, and is used to reduce energy loss generated in the first hydraulic fluid L1 flowing in the middle chamber 35. In addition, the cross-sectional area of the middle chamber 35 may be smaller than that of the small diameter piston 34 as long as energy loss is permitted.

The middle chamber 35 has a step portion where the large diameter piston cylinder and the small diameter piston cylinder intersect each other. It is desirable that energy loss caused by an increase or decrease in the cross-section is reduced by providing a circular-arc surface or a tapered surface in the step portion.

With the configuration of the hydraulic speed change device 30 described above, the fluid pressure generated by the first hydraulic fluid L1 acts on both the large diameter piston 32 and the small diameter piston 34. Accordingly, in accordance with Pascal's principle, the thrust force necessary for the small diameter piston 34 may be largely decreased (for example, by ¼ times) while increasing the movement speed of the small diameter piston 34 relative to the large diameter piston 32 (for example, by 4 times). That is, the hydraulic speed change device 30 serves as a speed increase device that communicates the movement of the large diameter piston 32 to the small diameter piston 34 while increasing the speed thereof.

On the contrary, the hydraulic speed change device 30 serves as a speed decrease device that communicates the linear movement of the brake member 26 as the vertical movement of the cushion pad 7 via the fluid pressure generated by the first hydraulic pressure L1 while decreasing the speed thereof. In this case, in accordance with Pascal's principle, the thrust force of the large diameter piston 32 may be largely increased (for example, by 4 times) while decreasing the movement speed of the large diameter piston 32 relative to the small diameter piston 34 (for example, by ¼ times).

In this example, the Pascal cylinder 36 includes an upper chamber 37*a* and a lower chamber 37*b* as well as the middle chamber 35. In addition, the upper chamber 37*a* and the lower chamber 37*b* enclose a noncompressible second hydraulic fluid L2 therein, and communicate with each other via a communication pipe 38.

The second hydraulic fluid L2 is preferably the same as the first hydraulic fluid L1, but may be different from the first hydraulic fluid L1.

In the upper chamber 37*a*, the portion on the side of the rod of the large diameter piston 32 is liquid-tightly sealed. In the lower chamber 37*b*, the portion on the side of the rod of the small diameter piston 34 is liquid-tightly sealed. Further, in this example, the upper chamber 37*a*, the lower chamber 37*b*, and the middle chamber 35 are integrally formed with each other.

It is desirable that the communication pipe 38 is a pipe used to allow the upper chamber 37*a* and the lower chamber 37*b* to communicate with each other such that energy loss generated in the second hydraulic fluid L2 is made to be as small as possible.

In FIG. 2, the die cushion device 10 of the invention further includes an upper chamber closing valve 39 and a closing valve controller 40.

The upper chamber closing valve 39 is, for example, a pilot check valve installed at the middle position in the communication pipe 38. The upper chamber closing valve 39 is adapted to be switchable by, for example, a pilot pressure of the pilot check valve between a "communication position" that the upper chamber 37*a* and the lower chamber 37*b* communicate with each other with small energy loss and a "non-return position" that the reverse flow of the second hydraulic fluid L2 from the upper chamber 37*a* to the lower chamber 37*b* is stopped.

The closing valve controller 40 controls the upper chamber closing valve 39 to be in the communication position or the non-return position by, for example, turning on or off a pilot pressure of the pilot check valve.

In this example, the die cushion device 10 of the invention further includes an air cushion 42 and an adjustment device 44.

In this example, the air cushion 42 includes air cushion chambers 42*a* and 42*b* communicating with each other in the vertical direction, and each of the air cushion chambers 42*a* and 42*b* communicates with an external air pressure tank not shown, whereby the upward cushion force is constantly applied to the cushion pad 7 due to the air pressure.

Since the air cushion 42 is provided, it is possible to reduce the output necessary for the linear driving device 20 and the hydraulic speed change device 30.

In addition, when the air cushion 42 is provided, the upper end of the piston rod 33 of the large diameter piston 32 is mechanically connected to the cushion pad 7, thereby applying the upward force and the downward force from the large diameter piston 32 to the cushion pad 7.

In this example, the adjustment device 44 includes an adjustment rod 44*a* that is adapted to move up and down along with the cushion pad 7 and a stopper 44*b* that is attached to the lower end of the adjustment rod 44*a* to adjust the vertical position, thereby minutely adjusting the upper limit position of the cushion pad 7.

Further, in this case, the upper end of the adjustment rod 44*a* is mechanically connected to the cushion pad 7, thereby preventing the cushion pad 7 from moving up beyond the upper limit position.

According to the die cushion device 10 of the first embodiment, the hydraulic speed change device 30 is provided so as to communicate the vertical movement of the cushion pad 7 receiving the impact force to the brake member 26 of the linear driving device 20 via the pressure of the enclosed hydraulic pressure in accordance with Pascal's principle while increasing the speed thereof. For this reason, since the impact force acting on the energy regenerating mechanism (the linear driving device) is alleviated, it is possible to improve the durability and impact resistance, and to regenerate energy from the accelerated brake member 26 with high efficiency.

In addition, since the hydraulic speed change device 30 converts the linear movement of the brake member 26 of the linear driving device 20 into the vertical movement of the cushion pad 7 via the pressure of the enclosed hydraulic fluid while decreasing the speed thereof, it is possible to reuse the regenerated energy and thus to improve overall energy efficiency.

Further, since the linear driving device 20 capable of regenerating energy has combination of the servo motor 22 and the ball screw 24, it is possible to realize a die cushion device having high efficiency by the use of the combination.

Furthermore, according to the die cushion device 10 of the first embodiment, since the cushion force is generated by both the air cushion 42 and the Pascal cylinder 36, it is possible to decrease the maximum output of the servo motor 22, and thus to decrease the cost of the entire die cushion device 10.

In addition, when the cushion pad 7 moves upward due to the air pressure accumulated in the air cushion 42 after the press passes the bottom dead center, the downward thrust force generated by the servo motor 22 and the ball screw 24 acts on the small diameter piston 34, and the pressure applied from the lower chamber 37*b* to the upper chamber 37*a* via the communication pipe 38 increases so as to generate the downward thrust force applied to the large diameter piston 32, thereby making the upward movement speed of the cushion pad 7 constant or decreasing the speed of the cushion pad 7 in the vicinity of the upward movement end.

That is, since the upward thrust force generated by the air cushion 42 constantly acts on the cushion pad 6, when suppressing the upward movement of the cushion pad or holding the position thereof in the case of the normal operation and power outage, the upper chamber closing valve 39 is switched to be in the non-return position by the pilot check valve 40 so as to seal the second hydraulic fluid L2 inside the upper chamber 37*a*.

Figure 3:
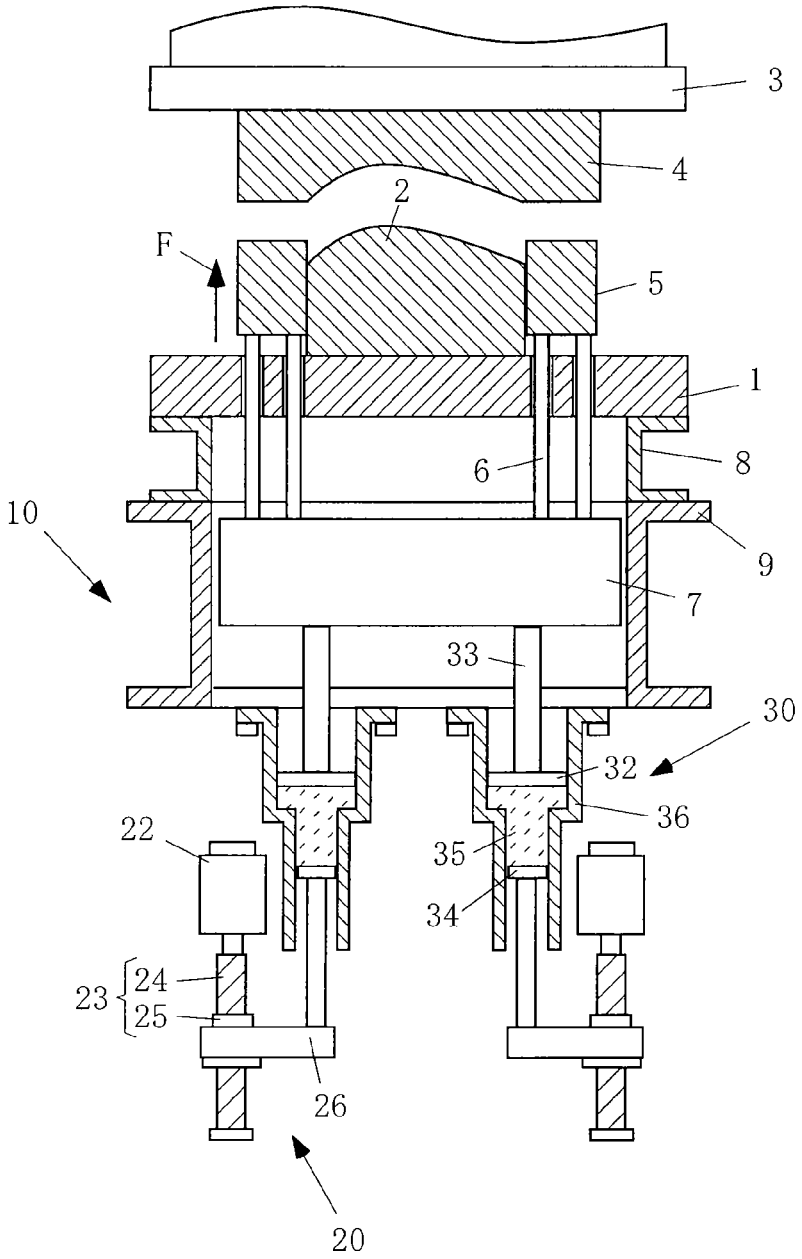
FIG. 3 is an overall configuration diagram illustrating a press machine equipped with a die cushion device according to a second embodiment of the invention.

FIG. 3 is an overall configuration diagram illustrating a press machine equipped with a die cushion device according to a second embodiment of the invention.

In this example, the Pascal cylinder 36 does not include the upper chamber 37*a* and the lower chamber 37*b* of the first embodiment, and the rod side of the large diameter piston 32 and the rod side of the small diameter piston 34 are opened. In addition, the communication pipe 38, the upper chamber closing valve 39, and the closing valve controller 40 of the first embodiment are also omitted.

Further, in this example, the air cushion 42 and the adjustment device 44 of the first embodiment are omitted.

The other configurations are the same as those of the first embodiment.

According to the die cushion device 10 of the second embodiment, the hydraulic speed change device 30 similar to the first embodiment is provided. For this reason, since the impact force acting on the energy regenerating mechanism (the linear driving device) is alleviated, it is possible to improve the durability and impact resistance, and to regenerate energy from the accelerated brake member 26 with high efficiency.

Further, since it is possible to reuse the regenerated energy, it is possible to improve overall energy efficiency, and to realize a die cushion device with high efficiency.

Figure 4:
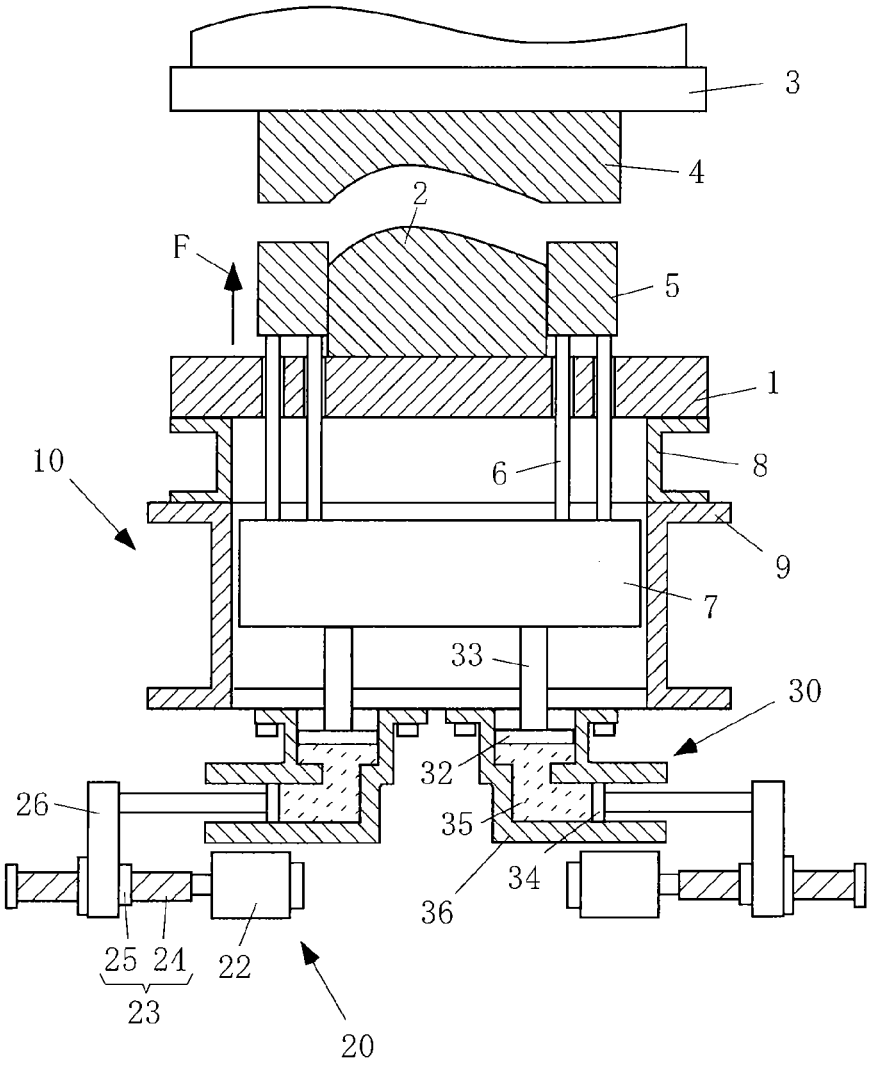
FIG. 4 is an overall configuration diagram illustrating a press machine equipped with a die cushion device according to a third embodiment of the invention.

FIG. 4 is an overall configuration diagram illustrating a press machine equipped with a die cushion device according to a third embodiment of the invention.

In this example, the Pascal cylinder 36 is adapted to linearly move the small diameter piston 34 in the horizontal direction. The movement direction of the small diameter piston 34 may be, for example, an inclination direction other than the horizontal direction.

The other configurations are the same as those of the second embodiment. Further, in this example, as in the first embodiment, the upper chamber 37*a*, the lower chamber 37*b*, the communication pipe 38, the upper chamber closing valve 39, the closing valve controller 40, the air cushion 42, and the adjustment device 44 may be provided.

With this configuration, it is possible to efficiently utilize the installation space. Further, the hydraulic speed change device 30 similar to the first embodiment is provided. For this reason, since the impact force acting on the energy regenerating mechanism (the linear driving device) is alleviated, it is possible to improve the durability and impact resistance, and to regenerate energy from the accelerated brake member 26 with high efficiency. Furthermore, since it is possible to reuse the regenerated energy, it is possible to improve overall energy efficiency, and to realize a die cushion device with high efficiency.

Figure 5:
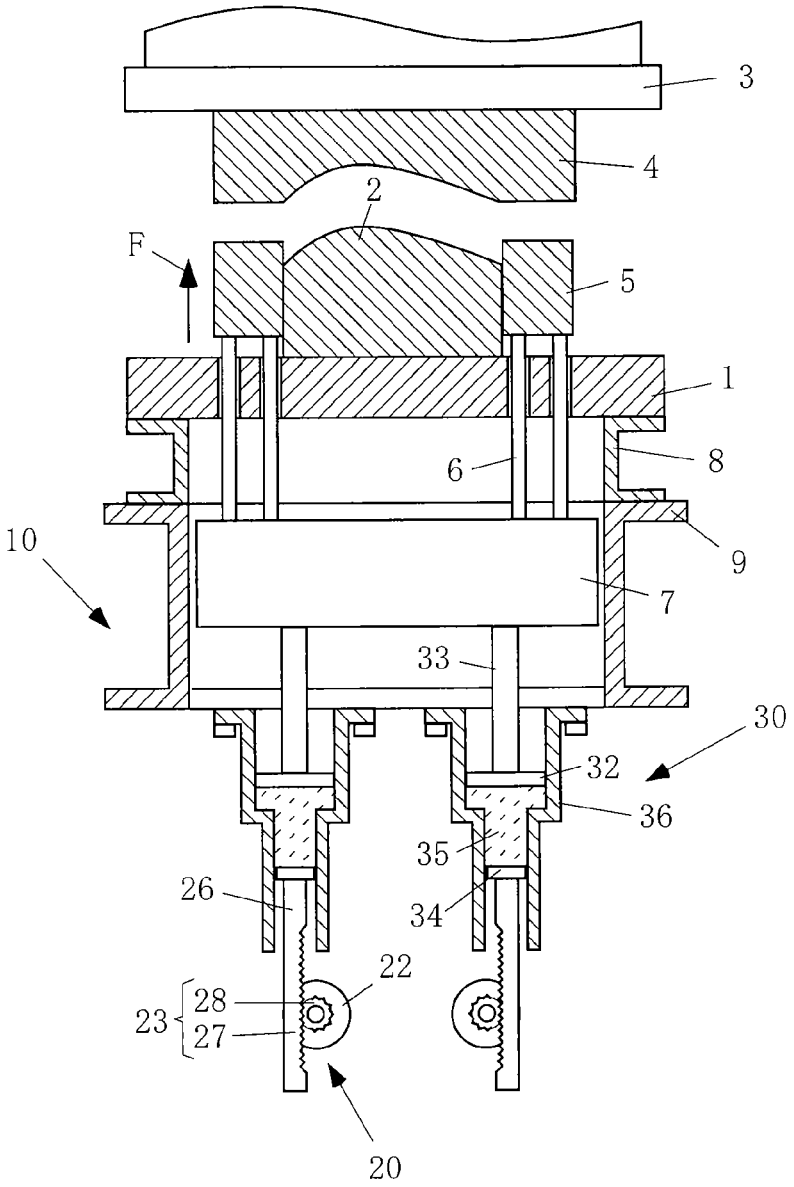
FIG. 5 is an overall configuration diagram illustrating a press machine equipped with a die cushion device according to a fourth embodiment of the invention.

FIG. 5 is an overall configuration diagram illustrating a press machine equipped with a die cushion device according to a fourth embodiment of the invention.

In this example, the conversion mechanism 23 includes a pinion 28 that is rotated by the servo motor 22 and a rack 27 that meshes with the pinion 28 and is fixed to the brake member 26. That is, the ball screw 24 and the nut 25 of the linear driving device 20 of the first embodiment are replaced by the rack 27 and the pinion 28. A part of the ball screws 24 and the nuts 25 of a plurality of linear driving devices 20 of the first embodiment may be replaced by the rack 27 and the pinion 28, or all of the ball screws 24 and the nuts 25 of a plurality of linear driving devices 20 of the first embodiment may be replaced by the racks 27 and the pinions 28.

In the case of using the rack 27 and the pinion 28, the brake member 26 is linearly moved by the rotation of the pinion 28.

The other configurations are the same as those of the second embodiment. Further, in this example, as in the first embodiment, the upper chamber 37*a*, the lower chamber 37*b*, the communication pipe 38, the upper chamber closing valve 39, the closing valve controller 40, the air cushion 42, and the adjustment device 44 may be provided.

With this configuration, the device may be more efficiently operated than a linear motor. Further, the hydraulic speed change device 30 similar to the first embodiment is provided. For this reason, since the impact force acting on the energy regenerating mechanism (the linear driving device) is alleviated, it is possible to improve the durability and impact resistance, and to regenerate energy from the accelerated brake member 26 and the accelerated rack 27 with high efficiency. Furthermore, since it is possible to reuse the regenerated energy, it is possible to improve overall energy efficiency.

Moreover, the invention is not limited to the above-described embodiments, but the invention includes modifications made within the scope of the appended claims, and modifications equivalent to the appended claims.

What is claimed is:

1. A die cushion device for a press machine that clamps a workpiece between a blank holder and an upper die of the press machine and moves the blank holder up and down while applying an upward cushion force to the blank holder via a cushion pad, the die cushion device comprising:

a linear driving device that drives a piston stop member along a predetermined line and regenerates energy from the linear movement of the piston stop member by combination of a servo motor and a conversion mechanism that converts the rotational movement of the servo motor into the linear movement of the piston stop member; and a hydraulic speed change device that transfers the speed of the cushion pad to the piston stop member via the pressure of noncompressible first hydraulic fluid while increasing the speed at a constant speed ratio and transfers the speed of the piston stop member to the cushion pad via the pressure of the hydraulic fluid while decreasing the speed at the constant speed ration; and an air cushion that constantly applies an upward cushion force to the cushion pad due to the air pressure, wherein the hydraulic speed change device includes a large diameter piston that is located below the cushion pad and is movable up and down along with the blank holder, a small diameter piston that is connected to the piston stop member to move linearly along with the piston stop member and has a diameter smaller than that of the large diameter piston, and a Pascal cylinder that guides the large diameter piston and the small diameter piston to be movable in an axial direction thereof and encloses the first hydraulic fluid between the large diameter piston and the small diameter piston, wherein the Pascal cylinder includes an upper chamber liquid-tightly sealing a rod side of the large diameter piston, a lower chamber liquid-tightly sealing a rod side of the small diameter piston, and a middle chamber liquid-tightly sealing a space between the large diameter piston and the small diameter piston that encloses the first hydraulic fluid therein, wherein the middle chamber is a communication channel where the large diameter piston cylinder and the small diameter piston cylinder are directly connected, and wherein the upper chamber and the lower chamber enclose a noncompressible second hydraulic fluid therein, and communicate with each other via a communication pipe.

2. The die cushion device according to claim 1, further comprising:

an upper chamber closing valve that is installed in the communication pipe and is switchable between a communication position that the upper chamber communicates with the lower chamber and a non-return position that the reverse flow of the second hydraulic fluid from the upper chamber to the lower chamber is stopped; and a closing valve controller that switches the upper chamber closing valve to the communication position or the non-return position.

3. The die cushion device according to claim 1, wherein the conversion mechanism includes a ball screw rotated by the servo motor and a nut threadably connected to the ball screw, and wherein the piston stop member is fixed to the nut and moves linearly along with the nut in accordance with the rotation of the ball screw.

4. The die cushion device according to claim 1, wherein the conversion mechanism includes a pinion rotated by the servo motor and a rack meshing with the pinion and fixed to the brake member, and wherein the brake member moves linearly in accordance with the rotation of the pinion.

5. The die cushion device according to claim 1, wherein the conversion mechanism includes a ball screw rotated by the servo motor and a nut threadably connected to the ball screw, and wherein the piston stop member is fixed to the nut and moves linearly along with the nut in accordance with the rotation of the ball screw.

6. The die cushion device according to claim 2, wherein the conversion mechanism includes a ball screw rotated by the servo motor and a nut threadably connected to the ball screw, and wherein the piston stop member is fixed to the nut and moves linearly along with the nut in accordance with the rotation of the ball screw.

7. The die cushion device according to claim 1, wherein the conversion mechanism includes a pinion rotated by the servo motor and a rack meshing with the pinion and fixed to the brake member, and wherein the brake member moves linearly in accordance with the rotation of the pinion.

8. The die cushion device according to claim 2, wherein the conversion mechanism includes a pinion rotated by the servo motor and a rack meshing with the pinion and fixed to the brake member, and wherein the brake member moves linearly in accordance with the rotation of the pinion.

9. The die cushion device according to claim 1, wherein the air cushion includes upper and low air cushion chambers communicating with each other in the vertical direction, and wherein each of the air cushion chambers communicates with an external air pressure tank, whereby the upward cushion force is constantly applied to the cushion pad due to the air pressure.

10. The die cushion device according to claim 1, wherein the middle chamber has a step portion where the large diameter piston cylinder and the small diameter piston cylinder intersect each other, and wherein a circular-arc surface or a tapered surface in the step portion is provided so that the energy loss caused by an increase or decrease in the cross-section is reduced.

* * * * *